United States Patent [19]

Ziegler et al.

[11] 4,118,272

[45] Oct. 3, 1978

[54] CONTINUOUS WET-LAID PROCESS FOR MAKING HIGH-STRENGTH GLASS FIBER MATS

[75] Inventors: Bertram Randall Ziegler, Freehold, N.J.; Edward J. Matteson, Hudson Falls, N.Y.

[73] Assignee: GAF Corporation, New York, N.Y.

[21] Appl. No.: 773,818

[22] Filed: Mar. 3, 1977 (Under 37 CFR 1.47)

[51] Int. Cl.[2] ..... D21F 11/00

[52] U.S. Cl. ..... 162/156; 162/190

[58] Field of Search ..... 162/156, 190, 216

[56] References Cited

U.S. PATENT DOCUMENTS

| | | | |
|---|---|---|---|
| 2,906,660 | 9/1959 | Hungerford et al. | 162/156 |
| 3,012,929 | 12/1961 | Jackson | 162/156 |
| 3,021,255 | 2/1962 | Simpson | 162/156 |
| 3,103,461 | 9/1963 | Smith et al. | 162/156 |
| 3,766,003 | 10/1973 | Schuller et al. | 162/156 |

OTHER PUBLICATIONS

Scheffel, "Glass, Cer., Quartz Fib. for the Paper Ind." TAPPI, vol. 58, No. 5 (1975) pp. 56–60.

Battista, "Syn. Fib. in Papermak." pp. 116, 117, 278–282.

*Primary Examiner*—S. Leon Bashore

*Assistant Examiner*—Peter Chin

*Attorney, Agent, or Firm*—Walter C. Kehm; Walter Katz

[57] ABSTRACT

A continuous wet-laid process for making high-strength glass fiber mats is described. In the process, glass fibers of known quantity are fed directly into a water stream of given volume to form a flowing fiber slurry of predetermined fiber consistency. Immediately thereafter, the flow of the slurry is interrupted turbulently to form a uniform fiber dispersion. The dispersion then is conveyed quickly onto a moving mat-forming wire screen to form the desired mat. The water thus-removed is recirculated into the original stream to provide a continuous operation. The process may be used advantageously for making high-strength mats of relatively long glass fibers, which find utility in the manufacture of asphalt roofing shingles, and as backing sheets for vinyl flooring.

7 Claims, 1 Drawing Figure

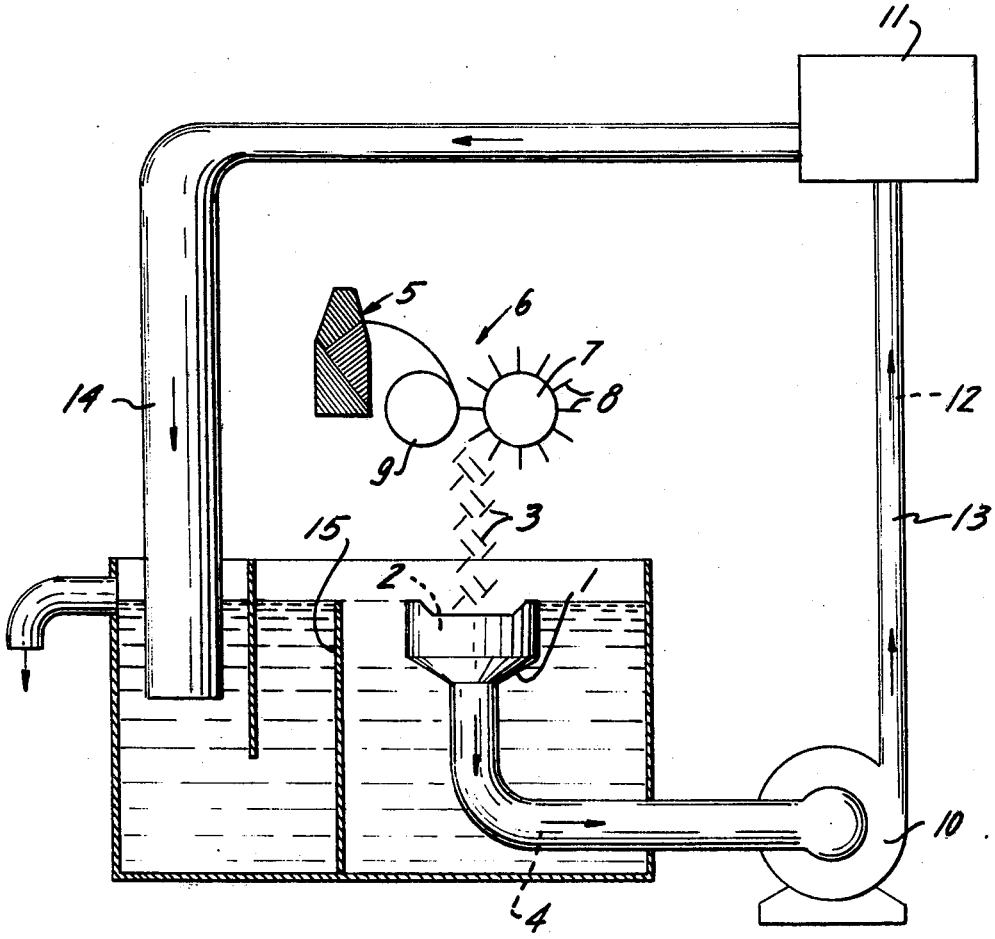
11
5
6
7
8
9
14
12
13
3
15
2
1
10
4

CONTINUOUS WET-LAID PROCESS FOR MAKING HIGH-STRENGTH GLASS FIBER MATS

BACKGROUND OF THE INVENTION

This invention relates to a continuous wet-laid process for making high-strength glass fiber mats.

High-strength, thin sheets or mats formed of glass fibers are finding increasing application in the building materials industry, as for example, in asphalt roofing shingles and as backing sheets for vinyl flooring. These glass fibers are replacing similar sheets made traditionally of organic or asbestos fibers. Such glass fiber mats may be made by the so-called "wet-laid process" on modified papermaking machinary as described in O. A. Battista, *Synthetic Fibers in Papermaking,* Wiley, (N.Y.) 1964 or in U.S. Pat. No. 3,905,067. However, since glass fiber mats useful for these building materials applications are relatively long by paper-making standards, normal processing in such equipment has presented numerous difficulties. In particular, such long fibers tend to rope or entangle when mixed or pumped during processing. To minimize this tendency it is necessary that expensive chemical additives be included in the process water. However, the additives may be more costly than the glass fibers themselves, and thus this solution to the problem is rather uneconomical. Another approach is to reduce the fiber consistency of the fiber dispersion being processed to a very low value. This prevents excessive entanglement of the fibers, but requires large volumes of water relative to the weight of the fibers themselves. Moreover, the excess water substantially increases the power consumption for the batch mixing and pumping of the water in the process. Furthermore, large tanks provided with expensive agitation equipment are necessary to prepare the initial fiber dispersion, and the rate of production of the mat is low, indeed.

SUMMARY OF THE INVENTION

Accordingly, it is an object of the present invention to provide a new and improved continuous process for making of high-strength glass fiber mats by the wet-laid method.

In keeping with the above principal object of the invention, and with others which will become apparent hereafter, one feature of the invention is the provision of a continuous wet-laid process for making high-strength glass fiber mats which includes first feeding a known quantity of glass fibers directly into a water stream of given volume to form a flowing fiber slurry having a predetermined fiber consistency, then quickly interrupting the flow of the slurry turbulently to form a uniform dispersion of the fibers, and finally, rapidly conveying the dispersion onto a mat forming screen to form the desired mat. Thereafter, the water is recirculated into the original water stream. As a feature of the invention, relatively long glass fibers may be processed into high-strength mats. With such long fibers however, it is necessary that they not be kept in the water stream enroute to the screen for an extended period of time, which would enable excessive entanglement of such fibers to occur.

The process of the present invention is particularly advantageous in that it does not require the conventional batch-type mixing tanks and agitation machinery for preparing fiber dispersions, previously deemed absolutely necessary in processing relatively long glass fibers into mats. In addition, plain water, that is, without chemical additives, may be used in the continuous process of this invention.

The glass fiber mats produced by the method of the present invention have its glass fibers enmeshed so as to promote mat integrity and strength. The mat has a multitude of interstices between enmeshed fibers which is desired in many commercial glass fiber mat products. Furthermore, it has a fine outer finish which also is a sought after physical characteristic when such mats are used as a reinforcement in resin laminates, for example, and in similar structures. The mat may be further characterized as having a plurality of enmeshed fibers substantially separated from each other, providing high tensile strength, interspersed with bundled fibers, or strands, which provide excellent tear strength properties.

Although the principles of the present invention are described as applying to the use of glass fibers, the invention is not limited thereto in view of the fact that it is readily applicable to other forms of different material, for example, to synthetic and natural fibers.

Other objects and features of the method of the invention will become readily apparent when the following description is taken in conjuction with the accompanying drawing, in which:

BRIEF DESCRIPTION OF THE DRAWING

The sole FIGURE is a diagrammatic illustration of apparatus suitable for carrying out the method of the invention.

DESCRIPTION OF THE INVENTION

Referring to the drawing in more detail, the FIGURE illustrates an apparatus suitable for use in the method of the invention and includes an inlet conduit 1 carrying a water stream 2 of given volume. The water stream originates in the continuous process from water removed during mat formation and recirculated into the conduit using an overflow tank to be described in more detail hereinafter. The water stream 2 in the inlet conduit 1 may be merely plain water without any chemical additives. However, if desired, some form of chemical additive may be included in the water. Preferably the conduit is flared at the top to provide a wide-mouth opening which can capture all fibers fed therein. A known quantity of glass fibers 3 is fed directly by gravity into the water stream to form a flowing fiber slurry 4 having a predetermined fiber consistency. The fiber slurry flows in the direction indicated by the arrow in inlet conduit 1.

The glass fibers 3 may be conveniently provided from a continuous glass strand 5 which is chopped into a plurality of individual glass fibers of desired length by the commercially available chopper element 6, e.g. Finn and Fram Model 80, sold by Finn and Fram, Inc., Sun Valley, Calif. The chopper 6 includes a rotatable cutting head roller 7 having cutting blades 8 which ride against a rubber anvil roller 9. The chopped strands or fibers are fed at a selected rate into the water stream 2 to provide the flowing fiber slurry 4 of desired fiber consistency.

The glass strands usually are chopped into chosen lengths between about ¼ inch to 3 inches. The individual fibers have a diameter between about $8\times10^{-5}$ to $8\times10^{-4}$ inches (2 to 20 microns).

Any commercially available type of glass fiber may be used in the process of this invention, as for example, those designated in the art as electrical, chemical and high-strength glass fibers. E-glass (electrical) is an inexpensive glass fiber which is very suitable for use therein. The glass fiber may be untreated on its surface or have a sizing or binder present on its surface which imparts wear resistance to handling of the strands. Either untreated or sized strands may be used in the process, although the structure of the mat will be somewhat different depending upon which type of glass strands are employed. Strands with sizing that do not dissolve in water will form mats which have an open structure while strands with sizing that dissolves in water provide mats of highly filamentized or individualized glass fibers in the mat. Unsized strands provide mats with a high degree of filamentation.

The consistency of the fiber slurry obtained upon addition of the chopped fibers in the water stream of the conduit is determined by the rate of flow of the water stream and the quantity of fibers added within a given period of time. Preferably the fiber consistency is adjusted to about 0.005% to 0.05% by weight of the fibers in water. Most preferably the fiber consistency is about 0.02% by weight which provides a reasonable rate of production of mats without any accompanying difficulties.

Immediately after the fiber slurry 4 is formed in inlet conduit 1, its flow is interrupted turbulently by pump 10 through which the slurry passes enroute to mat-forming wire screen 11. The action of pump 10 on the fiber slurry causes a redistribution of the fibers in the slurry to provide a uniform fiber dispersion 12 within outlet conduit 13. The fibers are kept in the water stream in advance of screen 11 either in slurry or dispersion form for a minimal period of time only in order to prevent excessive entangling of the long fibers before they can be processed into the desired mat on the wire screen. Preferably, the period of transit should be less than 10 seconds, although longer transit times may be used if a greater degree of entanglement of fibers can be tolerated in the final mat product.

Pump 10 may be any conventional pump such as is used in conventional paper machinery. A suitable pump is an open impeller centrifugal type which has large clearance tolerances so as to minimize impeller contact with the glass fibers.

The mat-forming moving wire screen 11 for forming the mat also may be conventional, such as for example, the screen described in U.S. Pat. No. 3,785,992. The moving wire screen 11 extends in the path of the flowing fiber dispersion. On the screen the fibers enmeshed themselves in the form of the mat product, and the water is removed therefrom, usually by suction devices (not shown) associated with the screen. The water thus-removed is recirculated into inlet conduit 1 via return conduit 14. The returned water flows into an over-flow tank 15 which drains into the inlet conduit 1 through the flared top opening.

The mats of the present invention are characterized by having high-strength properties, good fiber integrity and a rather smooth finish. The weight of the fibers in the mat usually is about 40 to 200 lbs. of fibers per 3,000 sq. ft. of mat. The tensile strength and tear strength of the mat produced herein is ordinarily at least 40 lbs. of force per lineal inch of mat and 700 grams, respectively.

The method of the invention thus provides an economical process of making such high-strength mats, even with long fibers, in a continuous manner and at reasonable rate of production.

While the invention has been described with particular reference to certain embodiments thereof, it will be understood by those skilled in the art that possible modifications and substitutions may be made which are within the skill of the art and those changes are considered within the spirit and scope of this invention.

What we claim is:

1. A continuous wet-laid process for making high-strength glass fiber mats consisting essentially of:

a. continuously feeding a known quantity of dry glass fibers of about ¼ inch to 3 inches in length, that is without prior mixing of said fibers in water in tanks, or agitation thereof, directly into an inlet conduit carrying a flowing water stream to form a continuously flowing fiber slurry having a fiber consistency of 0.005 to 0.05% by weight of said fibers in water, b. continuously pumping said slurry turbulently to form a uniform dispersion said fibers, c. continuously conveying said dispersion onto a mat-forming screen, said fibers being kept in said water stream enroute to said screen for a minimal period only in order to prevent excessive entangling of said fibers within said stream, d. continuously forming said mat on said screen from fibers of said dispersion while removing water therefrom, and, e. continuously recirculating the water thus-removed into said stream of step a).

2. A process according to claim 1 wherein said fiber consistency is about 0.02% by weight of said fibers in water.

3. A process according to claim 1 wherein said fibers are about $8\times10^{-5}$ to $8\times10^{-4}$ inches in diameter.

4. A process according to claim 1 wherein said glass fibers are provided with sizing material thereon.

5. A process according to claim 1 wherein said fibers are retained for less than 10 seconds in said water stream.

6. A process according to claim 1 wherein said mat has a fiber weight of about 40 to 200 lbs. of fibers per 3,000 sq. ft. of mat.

7. A process according to claim 1 wherein said mat has a tensile strength of at least 40 lbs. of force per lineal inch of mat, and a tear strength of at least 700 grams.

* * * * *